US007592033B2

(12) United States Patent
Buckley et al.

(10) Patent No.: US 7,592,033 B2
(45) Date of Patent: Sep. 22, 2009

(54) VARIABLE FLUID DISPENSER

(75) Inventors: Ian J. Buckley, Littleton, CO (US); William W. Weil, Golden, CO (US); Scott J. Woolley, Golden, CO (US)

(73) Assignee: Computrol, Inc, Golden, CO (US)

( * ) Notice: Subject to any disclaimer, the term of this patent is extended or adjusted under 35 U.S.C. 154(b) by 893 days.

(21) Appl. No.: 10/888,696

(22) Filed: Jul. 8, 2004

(65) Prior Publication Data

US 2005/0158467 A1 Jul. 21, 2005

Related U.S. Application Data

(60) Provisional application No. 60/485,701, filed on Jul. 8, 2003.

(51) Int. Cl.
*B05D 1/26* (2006.01)

(52) U.S. Cl. ..... 427/8; 427/427.2

(58) Field of Classification Search ..... 427/8, 427/427.2

See application file for complete search history.

(56) References Cited

U.S. PATENT DOCUMENTS

| | | | | |
|---|---|---|---|---|
| 1,639,118 | A | 8/1927 | Troyer et al. | |
| 1,782,450 | A | 11/1930 | Taylor | |
| 1,838,082 | A | 12/1931 | Coyle | |
| 2,189,783 | A * | 2/1940 | Eberhart | 427/233 |
| 2,287,356 | A | 6/1942 | Newman | |
| 2,419,951 | A | 5/1947 | Kastel | |
| 2,587,538 | A | 2/1952 | Seaman | |
| 2,732,315 | A | 1/1956 | Birkland | |
| 2,896,378 | A | 7/1959 | Keating | |
| 3,001,586 | A | 9/1961 | Kyle | |
| 3,412,971 | A | 11/1968 | McDivitt | |
| 3,521,598 | A | 7/1970 | Straw | |
| 3,575,131 | A | 4/1971 | Lohmann | |
| 3,612,479 | A | 10/1971 | Smith Jr. | |
| 3,641,959 | A | 2/1972 | Hurst | |
| 3,761,053 | A | 9/1973 | Bedo et al. | |
| 3,780,981 | A | 12/1973 | Horak et al. | |
| 3,852,095 | A | 12/1974 | Hogstrom | |
| 3,876,144 | A | 4/1975 | Madden et al. | |
| 4,262,629 | A | 4/1981 | McConnellogue et al. | |
| 4,295,573 | A | 10/1981 | Terry et al. | |
| 4,342,443 | A | 8/1982 | Wakeman | |
| 4,437,488 | A | 3/1984 | Taggart et al. | |
| 4,498,415 | A | 2/1985 | Tsuchiya et al. | |
| 4,546,955 | A | 10/1985 | Beyer et al. | |
| 4,840,138 | A | 6/1989 | Stirbis | |
| 4,852,773 | A | 8/1989 | Standlick et al. | |
| 4,884,720 | A | 12/1989 | Whigham et al. | |
| 4,958,769 | A | 9/1990 | Schowiak | |
| 5,197,508 | A | 3/1993 | Gottling et al. | |
| 5,215,587 | A | 6/1993 | McConnellogue et al. | |

(Continued)

*Primary Examiner*—Kirsten C Jolley
(74) *Attorney, Agent, or Firm*—Russell S. Krajec; Krajec Patent Offices, LLC

(57) ABSTRACT

A dispenser that dispenses fluid is controlled using a feedback control system. The control system uses a positional encoder to determine the precise position of a valve contained in an actuator in order to control the dispensing of the fluid. Various motion profiles may be used to control the position of the valve. The motion profiles of the valve enable controlled variation of the amount of fluid dispensed over time and enable several specific improvements to the dispensing of sealant in the manufacture of metal and composite cans.

12 Claims, 8 Drawing Sheets

U.S. PATENT DOCUMENTS 5,263,608 A 11/1993 Kiernan et al.
5,272,902 A 12/1993 Kobak
5,296,035 A 3/1994 Chicatelli et al.
5,419,492 A 5/1995 Gant et al.
RE35,010 E * 8/1995 Price ..... 222/1
5,455,067 A 10/1995 Chicatelli et al.
5,476,362 A 12/1995 Kobak et al.
5,533,853 A 7/1996 Wu
5,564,877 A 10/1996 Hamilton
5,636,447 A 6/1997 Yount et al.
5,749,969 A 5/1998 Kobak et al.
5,945,160 A 8/1999 Kobak et al.
5,995,909 A * 11/1999 Bretmersky et al. ..... 702/50
6,010,740 A 1/2000 Rutledge et al.
6,113,333 A 9/2000 Rutledge et al.
6,391,387 B1 5/2002 Rutledge et al.
2003/0184744 A1 10/2003 Isozaki et al.

* cited by examiner

VARIABLE FLUID DISPENSER

CROSS REFERENCE TO RELATED APPLICATIONS

The present application is based upon and claims the benefit of U.S. Provisional Patent Application Ser. No. 60/485,701 by William W. Weil, et al., entitled "Fluid Dispensing Actuator" filed Jul. 8, 2003, the entire contents of which is hereby specifically incorporated by reference for all it discloses and teaches.

BACKGROUND OF THE INVENTION a. Field of the Invention

The present invention generally pertains to fluid dispensing systems and more particularly to actuators that control the amount of a fluid being dispensed.

b. Description of the Background

Fluid dispensers are used in different manufacturing industries to dispense fluids, such as an adhesive, plastisol, sealant or other compounds. In the container industry, for example, it is common to apply a sealant to a can end prior to assembly. The sealant provides a proper seal between the end and a body of a can.

In a typical actuator, a valve is simply opened and closed to dispense a fluid. Existing electrically-controlled valves typically contain two parts: an actuator that quickly opens and closes the valve, and an adjustable stop that sets how far the valve is opened when it is actuated. The actuator that opens and closes the valve may be a solenoid, pneumatic cylinder, or other device designed to quickly open and close the valve. The adjustable stop may be moved by a stepper motor, a stepper solenoid, or by a manual adjustment. One system is described in U.S. Pat. No. 6,010,740 of Rutledge et al. entitled "Fluid Dispensing System," which is specifically incorporated herein by reference for all that it discloses and teaches.

Using a solenoid to quickly open and close a valve presents some limitations. The mechanism is designed to open and close the valve as quickly as possible. Yet the mechanism has a response time that delays the opening and closing of the valve. The response time may vary due to such factors as the length of stroke. Further, the response of the valve may change with the temperature of the actuator. As the actuator heats up due to repetitive use or environmental factors, the force applied by the actuator may change, thereby changing the response of the valve. The valve itself has a rate of opening and closing that cannot be controlled. Additionally, the exact position of the valve is typically unknown during movement, increasing variability.

A second limitation is that there is typically no way to vary the flow rate of the liquid at any point during the period that the valve is being actuated. In some applications, such as the application of sealant during the manufacturing of cans, it may be desirable to add more sealant in one area and less in another.

SUMMARY OF THE INVENTION

The present invention overcomes the disadvantages and limitations of the prior art by providing a dispenser that is capable of dispensing a fluid in a controlled manner.

The present invention may therefore comprise a method of applying a sealant to a can end in a controlled manner in accordance with a profile comprising: generating a profile signal that is representative of the profile; providing a dispenser that dispenses the sealant to the can end, the dispenser having a fixed portion and a moving portion that define a variable size opening through which the sealant flows through the dispenser; detecting a position of the moving portion of the dispenser with respect to the fixed portion; generating an encoder signal that is indicative the position of the moving portion; applying the profile signal and the encoder signal to a controller; generating a control signal representative of the difference between the profile signal and the encoder signal; applying the control signal to an actuator that is coupled to the moving portion that moves the moving portion in response to the control signal so that the moving portion is moved to a position that matches the profile.

The present invention may further comprise a device for applying sealant to a can end comprising: a valve having a fixed portion and a moving portion, the fixed portion and the moving portion defining a variable size opening that regulates the amount of the sealant that is dispensed from the valve as the moving portion is moved relative to the fixed portion; a profile signal that defines a desired movement of the moving portion of the valve; an encoder that detects a position of the moving portion and generates an encoder signal representative of the position of the moving portion; a controller that compares the encoder signal and the profile signal and generates a control signal; an actuator that moves the moving portion of the valve in response to the control signal.

Advantages of the present invention include the ability to dispense consistent and repeatable amounts of fluid. Further, the rate of opening and closing the valve may be varied, allowing the valve position to be changed at a desired rate. The amount of time the valve is open and the flow rate can both be more accurately controlled. The amount the valve is actually opened can be controlled to control the amount of fluid that is dispensed.

DETAILED DESCRIPTION OF THE INVENTION

Figure 1:
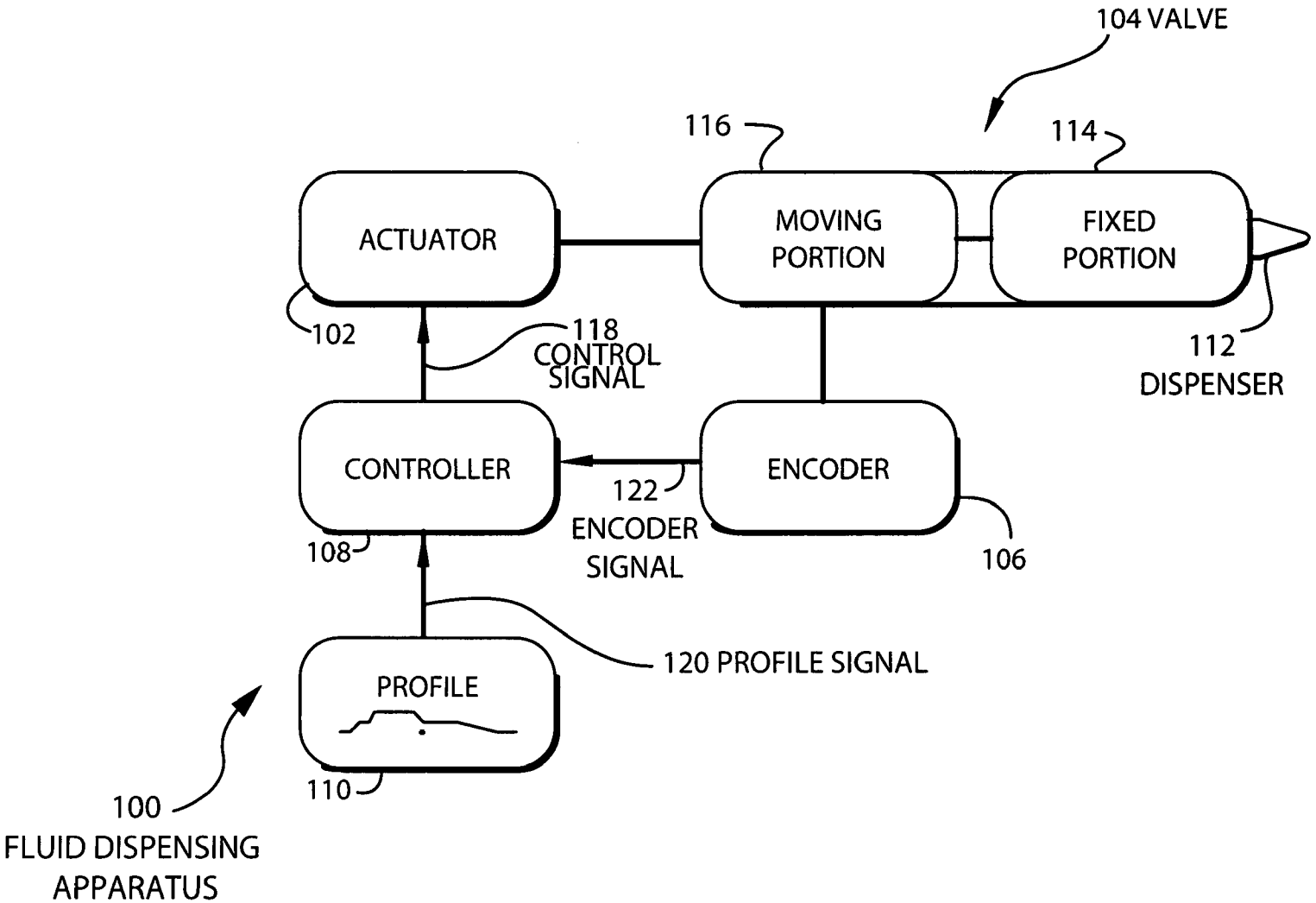
FIG. 1 is a schematic block diagram of an embodiment of the present invention showing the various elements of the present invention.

FIG. 1 is a schematic block diagram 100 illustrating the basic operation of the various elements of an embodiment of the present invention. An actuator 102 is connected to a valve 104 having a moving portion and a fixed portion. The moving portion of the valve 104 is moved by the actuator 102, and the position of the moving portion of the valve 104 is captured by an encoder 106. The controller 108 compares the value of the encoder 106 with the desired profile 110 and adjusts the actuator 102 as necessary so that the position of the moving portion of the valve 104, as detected by the encoder 106, is equal to the value of the desired profile 110. As the valve 104 opens, fluid may be dispensed in an amount in accordance with the desired profile 110 through the dispenser 112.

The embodiment 100 may be used to dispense fluids in various applications for different industries. For example, in can manufacturing, the system may be used to dispense liner compound (sealant) to the can ends prior to assembly on a can body. In another example, the system may be used to dispense caulking, glue, or adhesive for various assembly tasks, wherever these materials are to be dispensed in a controlled manner.

The actuator 102 is a device that causes mechanical motion between the fixed portion 114 and moving portion 116 of the valve. The moving portion 116 of the valve 104 may fit together with the fixed portion 114 so that when both portions are in contact, fluid cannot flow between them. When the portions separate, a gap is created through which a fluid may flow. This gap may vary proportionately with the distance between the moving portion 116 of the valve 104, and the fixed portion 114 of the valve 104 so that fluid flow increases as the distance between the moving portion 116 and the fixed portion 114 increases. By controlling the position of the moving portion 116 with respect to the fixed portion 114, the size of the opening can be controlled, and thus, the amount of fluid dispensed can be controlled.

Various mechanical valve configurations may be used for different applications. In one example, the moving portion 116 of the valve may have a cone-shaped feature that engages a conical orifice in the fixed portion 114. Those skilled in the arts will appreciate the various configurations of valves that may be adapted for use in the present invention, while maintaining the spirit and intent of the present invention.

The valve 104 may operate to control the dispensing of a pressurized fluid. The fluid may be any liquid or other compound capable of flow under pressurized conditions. Examples of compounds that may be pressurized and controlled may include adhesives, paints, sealants, caulks, soaps, gels, slurries, various flowable foodstuffs, powders, oils, curable epoxies, suspensions, plastisols, and other fluids and pastes. These materials (fluids) can be applied for any desired application.

The valve 104 may be mounted on various types of machines used in manufacturing lines. The valve may be part of an actuator that is moved over a work piece or may be fixedly-mounted and have a work piece presented to the actuator.

The encoder 106 is a measuring sensor that detects the position of the moving portion of the valve 104 with respect to the fixed portion of the valve and generates a signal representative of the position. The encoder 106 may be a linear encoder or a rotary encoder, such as a shaft encoder, and may generate an absolute or relative value. The encoder 106 may be mounted to the moving portion of the valve 104, or may be coupled through a mechanism to the moving portion of the valve 104.

The range of discrete values spanned by the encoder 106 may be proportional to the maximum size of the gap between the moving portion 116 of the valve 104 and the fixed portion 114 of the valve 104. As the actuator 102 moves the moving portion 116 of the valve 104, the position of the moving portion 116 of the valve 104 is detected by the encoder 106 and translated into a discrete encoder value in real time.

Several different types of encoders are readily available. Any type may be used with the various embodiments of the present invention. One general type of encoder 106 that may be used is a shaft encoder, which captures the rotational movement of the actuator 102. Such an encoder may measure the full travel of the moving portion of the valve 104 in fractional or whole rotations of the encoder. A rotary encoder 106 may be mounted to a drive motor or may be separately coupled to the moving portion of the valve 104 through a rack and pinion or other mechanical linkage.

Another general type of encoder 106 measures linear movement. A linear encoder may optically, electrically, magnetically or mechanically sense the position of the moving portion of the valve. Mechanical detectors may be coupled directly to the moving portion of the valve 104 or may be mechanically coupled to the moving portion of the valve 104 though any type of mechanical linkage.

The encoder 106 may be either a digital or analog device. A digital device may return a digitized distance measurement, whereas an analog device, such as a resolver, may return analog signals that may or may not be converted to a digital equivalent. Any type of distance measurement device may be used as the encoder 106 of the present invention while keeping within the spirit and intent of the present invention.

The controller 108 may be a closed-loop controller that controls the actuator 102 based on the feedback of the encoder 106 by comparing the profile signal 120 with the encoder signal 122. If a difference exists, an output control signal 118, such as a difference signal or a control signal generated from a Proportional Integral Derivative Filter with output offset, multiple feed-forward terms, notch filters and/or compensation tables, is generated by controller 108 and applied to actuator 102. The actuator 102 then controls the position of the moving portion 116 of the valve 104 so that the moving portion 116 follows the motion profile 110. In this fashion, the motion of the moving portion 116 of the valve 104 may be controlled in real time using feedback from encoder 106. Open loop systems with no feedback can also be used that generate estimated responses. Various motion profiles 110 may be used to define the desired motion of the valve. For example, the motion profile 110 may define the desired position with respect to time. In other examples, the motion profile 110 may be defined with desired velocity, force, acceleration, jerk, or other variables such as force, torque, etc., that may be used to define the desired movement of the valve.

Figure 2:
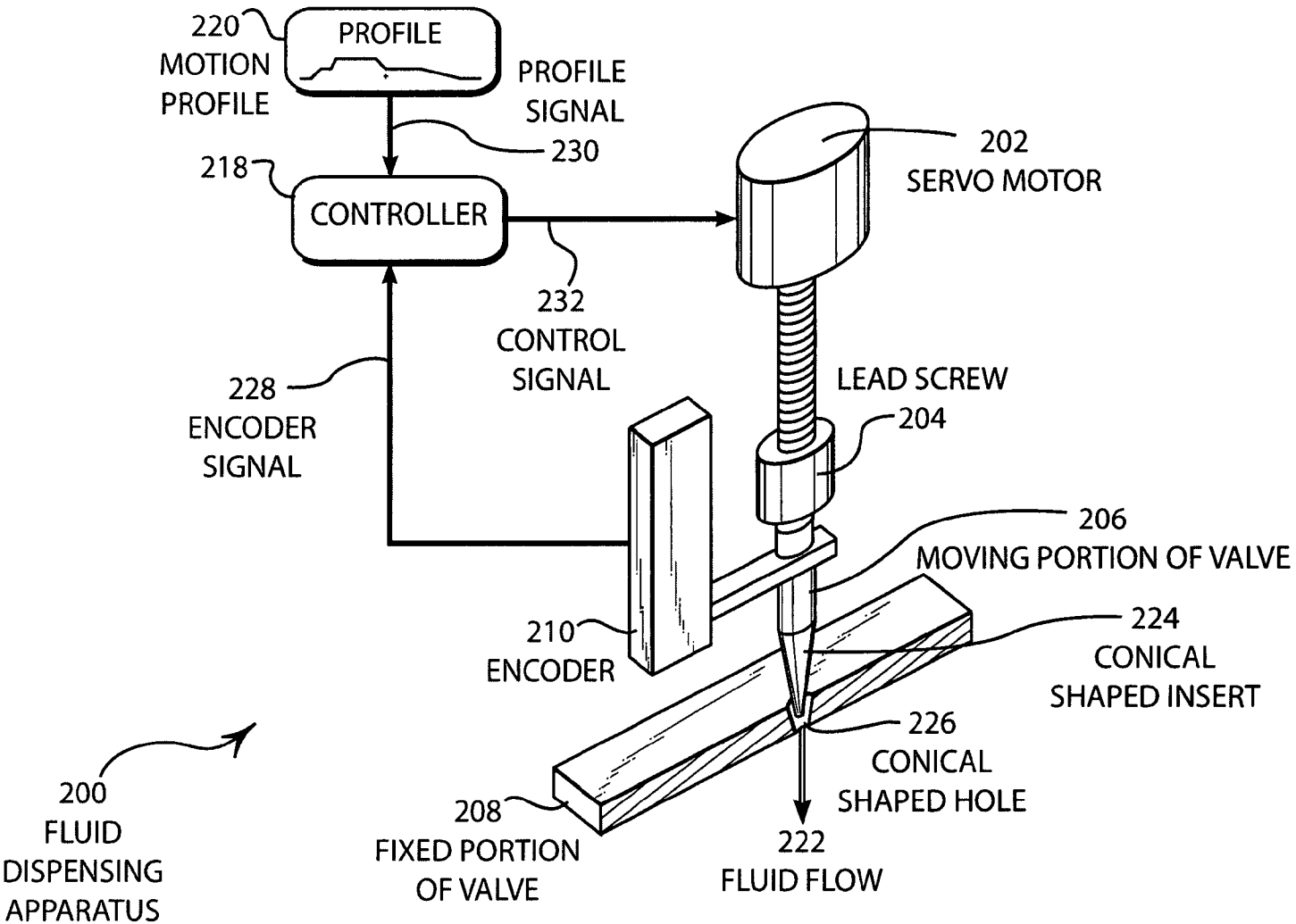
FIG. 2 is a schematic illustration of an embodiment of the present invention showing a lead screw driven valve.

FIG. 2 illustrates an embodiment 200 having a lead screw driven actuator. A servo-motor 202 is connected to a lead screw 204 that drives the moving portion 206 of the valve with respect to the fixed portion 208 of the valve. An encoder 210 is mounted directly to the moving portion 206 and/or the servo-motor 202. The output of the encoder 210 is an encoder signal 228 that indicates the position of the moving portion 206. The encoder signal 228 is connected to the controller 218 that controls the servo-motor 202 by comparing the profile signal 230 with the encoder signal 228. If a difference exists, a control signal 232 is generated that can comprise any desired type of control signal, as disclosed above, by the controller 218 and applied to the servo-motor 202 so that the motion of the moving portion 206 of the valve follows the motion profile 220.

The flow of the fluid 222 may be regulated by a conically shaped insert 224 that may fit into a conically shaped hole 226. When the insert 224 and the hole 226 are seated into each other, the fluid flow 222 may be fully stopped. Various shapes and configurations of valves may be used by those skilled in the art while keeping within the spirit and intent of the present invention.

As indicated above, the controller 218 compares the value of the encoder 210 as represented by the encoder signal 228 with the desired profile 220, as represented by the profile signal 230, and adjusts the servo-motor 202 so the position of the moving portion 206 of the valve, as received by the encoder 210, is equal to the value of the desired profile 220. When the moving portion of the valve 206 is not touching the fixed portion of the valve 208, fluid flow 222 is dispensed in an amount that corresponds to the desired profile 220.

The servo-motor 202 may be a brushless DC motor or may be any other type of rotary actuator. For example, a rotary stepper solenoid, servo-stepper motor, AC motor, brushless DC motor, or any other type of controllable rotary actuator can be used. In some embodiments, hydraulic or pneumatic rotary actuators may be used.

Figure 5:
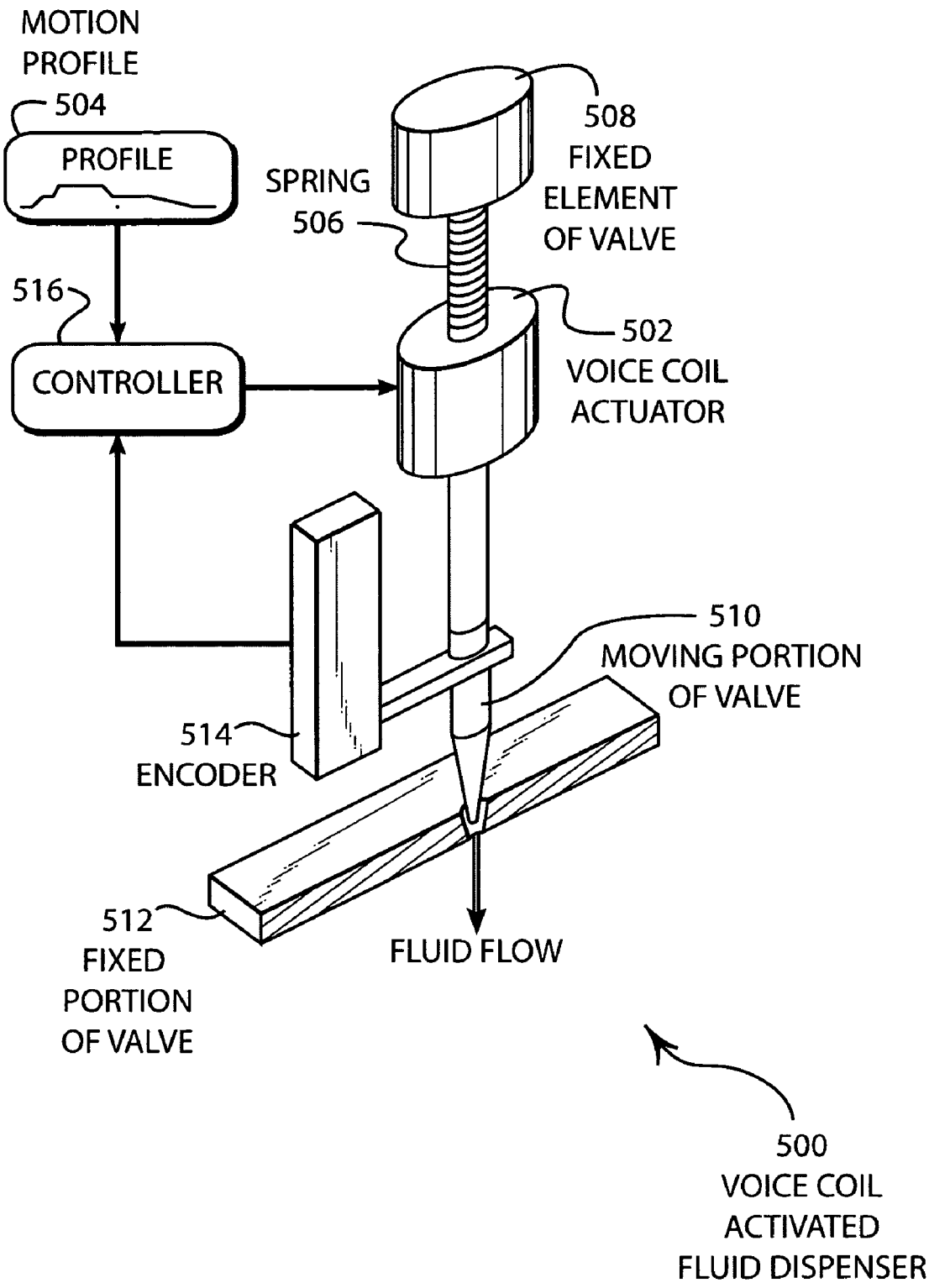
FIG. 5 is a schematic illustration of an embodiment of the present invention showing the use of a spring and a voice coil driven valve.
Figure 6:
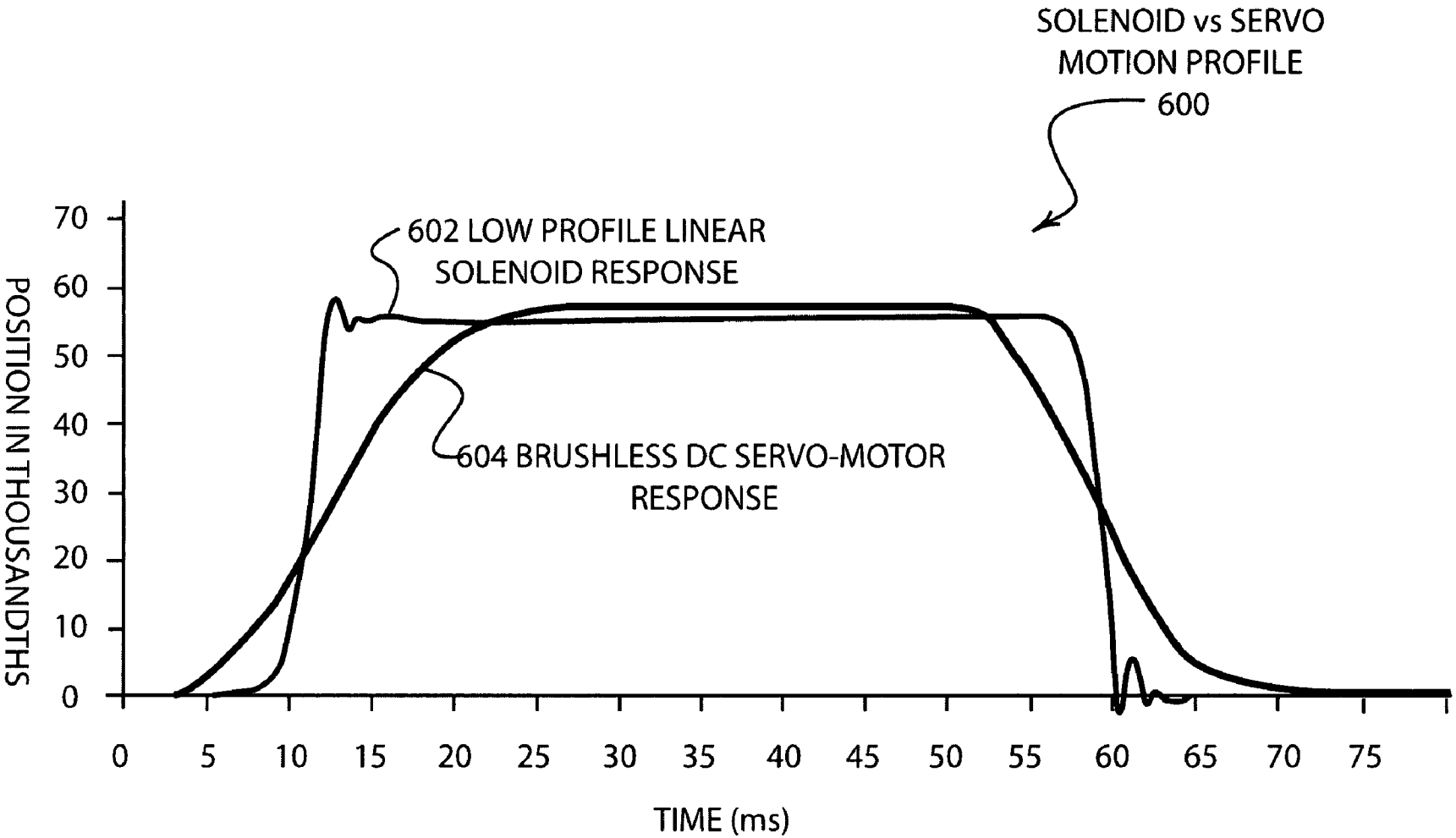
FIG. 6 is a graph of the response of a rotary stepper solenoid versus a servo-stepper motor.

FIG. 6 is a graph of the response 602 of a low profile linear solenoid and the response 604 of a brushless DC servo-motor, showing the change in position in thousandths of an inch versus time in ms. As shown in FIG. 6, the position of the device is shown in the vertical axis and the time response is shown in the horizontal axis. The low profile linear solenoid response 602 opens and closes the valve of the dispenser much quicker than the brushless DC servo-motor response 604. The response of the voice coil actuator 502, disclosed in more detail with respect to FIG. 5 below, and voice coil actuator 806, disclosed in more detail with respect to FIG. 8 below, is similar to the low profile linear solenoid, but allows the position of the dispensing valve to be very carefully controlled.

In the embodiment 200, the linear encoder 210 is directly connected to the moving portion 206 of the valve. The linear encoder 210 is capable of generating an encoder signal 228 that can be an absolute or relative signal indicating the motion of the moving portion 206. In some embodiments, limit switches or other sensors may be used in conjunction with the linear encoder 210 as an input to the controller 218.

The mechanism that incorporates the lead screw 204 illustrates how the rotary motion of the servo-motor 202 may be translated into linear motion that is more or less aligned with the axis of the motor 204. In some embodiments, planetary gears or other speed reducers may be used by those skilled in the art to match the intended speed and other parameters of actuation of the particular embodiment as necessary.

The motion profile 220 may be defined in terms of the desired movement over time. For example, the motion profile may define the movement in terms of the desired position, velocity, acceleration, jerk, or other parameter with respect to time. Additionally, the embodiment may be capable of defining movement in terms of the amount of force to be exerted. In some embodiments, it may be desirable for the controller 218 to cause the motor 202 to exert a specified force between the moving portion 206 and the fixed portion 208 of the valve in order to seal the valve.

In some embodiments, a linear actuator may be used in place of a rotary actuator and a lead screw. A linear actuator may include a linear motor, moving coil, voice coil (all illustrated in FIG. 5), variable stroke linear solenoid, or any other type of controllable actuator with a linear movement. In such embodiments, the linear actuator may be directly connected to the moving portion 206 of the valve, or may be coupled to the moving portion 206 of the valve through various mechanisms that may include various gears or linkages.

In some embodiments, the moving portion of the valve may cause a positive displacement of a chamber that may thereby cause the fluid to be dispensed. For example, the moving portion of the valve may cause the plunger of a syringe or other collapsible cavity to be moved such that fluid is dispensed.

Figure 7:
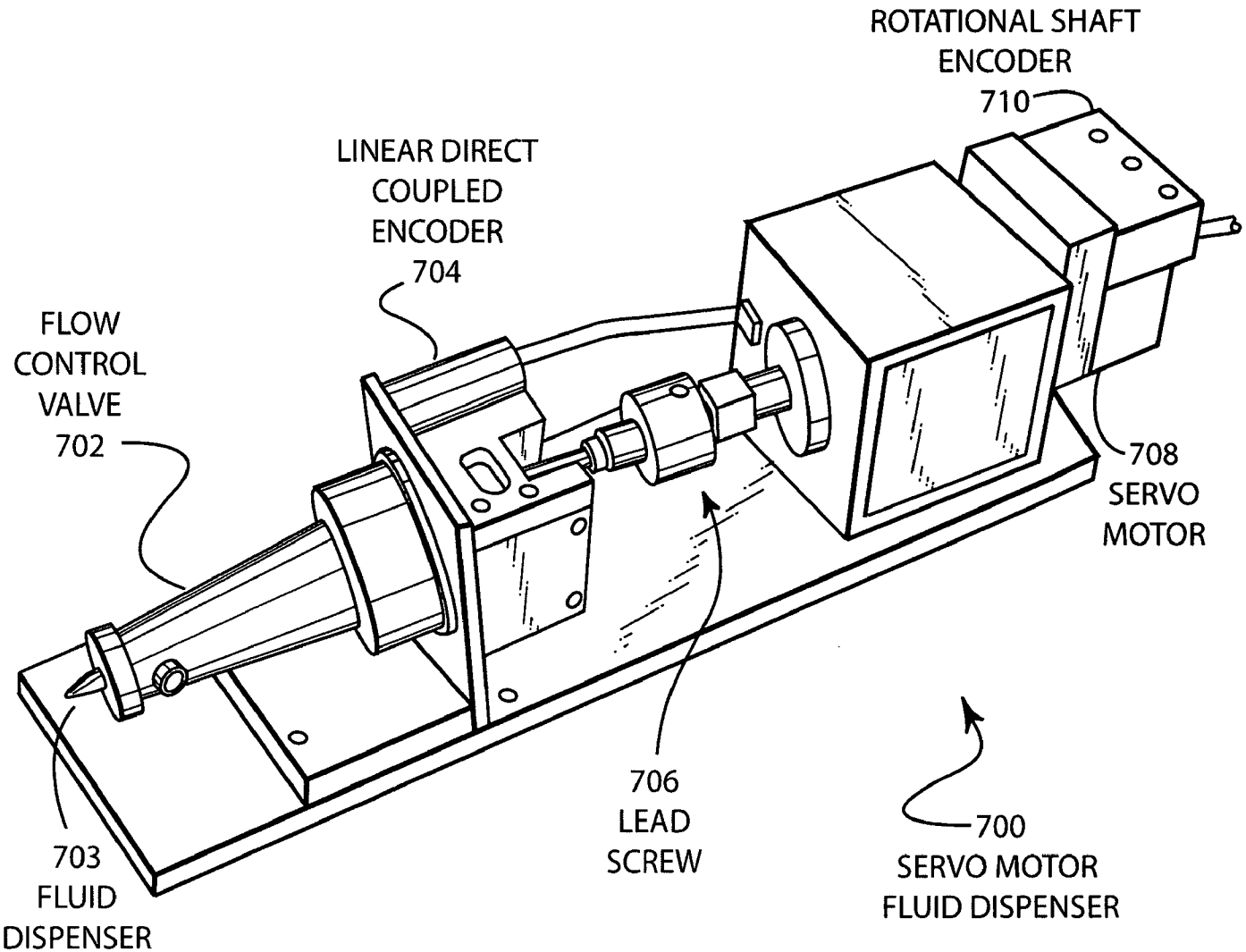
FIG. 7 is an illustration of an embodiment of a servo-motor dispenser.

In still other embodiments, a second encoder, such as linear direct coupled encoder 704, that is described in more detail with respect to FIG. 7, may be provided on the shaft of the servo-motor 202. The second encoder may be used to calibrate the servo-motor 202 or to perform other functions associated with controlling the motor. The output signal of the second encoder may be compared to the output signal 228 of the encoder 210 to verify proper functioning of the mechanical linkage that drives the moving portion 206 of the valve.

Figure 3:
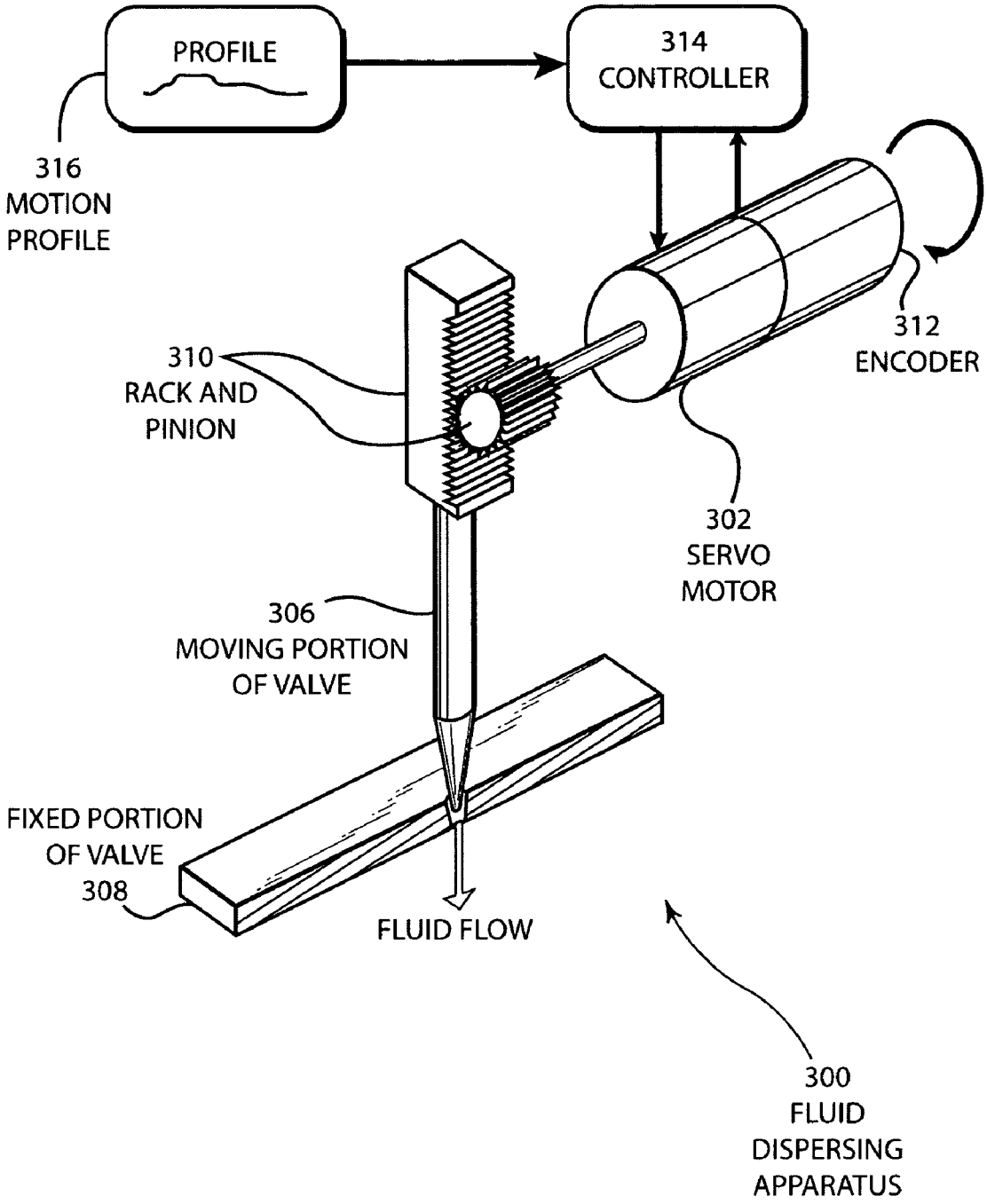
FIG. 3 is a schematic illustration of an embodiment of the present invention showing a rack and pinion driven valve.

FIG. 3 is a schematic representation of an embodiment 300 of the present invention showing a rack and pinion driven valve. The valve 304 may have a moving portion 306 and a fixed portion 308 that are adapted to fit into each other and prevent any fluid flow. The rack and pinion 310 may cause the moving portion 306 of the valve to translate when the motor 302 rotates. As the moving portion of the valve 306 is moved by the rack and pinion 310, the position and/or velocity of the moving portion 306 is captured by an encoder 312 mounted to the shaft of the motor 302 and/or an encoder mounted to the moving piece of the valve. The controller 314 compares the input from the encoder 312 with the desired profile 316 to control the motor 302.

The embodiment 300 illustrates a mechanism whereby a rotational motion from the motor 302 may be translated to a linear motion of the moving portion 306 of the valve in a proportional manner. The mechanism further allows the axis of the motor 302 to be perpendicular to axis of the moving portion 306 of the valve.

The mechanism for translating rotational motion to linear motion may operate in a fixed ratio of angular motion to linear motion such as the rack and pinion mechanism. In other embodiments, a mechanism may be used to translate rotational motion into linear motion that may not necessarily produce a fixed ratio of movement between the rotary motion and the linear motion. As those skilled in the art will appreciate, such mechanisms may have particular advantages in specific applications. Examples of such mechanisms include a drag link mechanism, a Whitworth mechanism, a crank shaper mechanism, a scotch yoke mechanism, the many variations of the crank and slider mechanism, toggle-type mechanisms, various cam mechanisms, cable and drum mechanisms, belt and pulley mechanisms, a Watts mechanism, an Oldham coupling mechanism, various four bar linkages including the Peaucellier mechanism, and any other desired mechanism.

In some embodiments, the mechanism may include a lever, gear, or other speed increasing or decreasing device. For example, if the motor 302 was selected to be a low power motor, the pinion of the rack and pinion 310 may also be selected to be small such that the motor 302 has sufficient power to operate the valve. In such an example, the smaller pinion will cause the speed of the rack to be less and the speed of the embodiment will be sacrificed for the various benefits of a smaller motor.

In another example, a lever linkage may be used to increase the speed of movement of the moving portion 306 of the valve. In such a case, proportionally small movements of the motor 302 may cause larger movements of the moving portion 306 of the valve.

Figure 4:
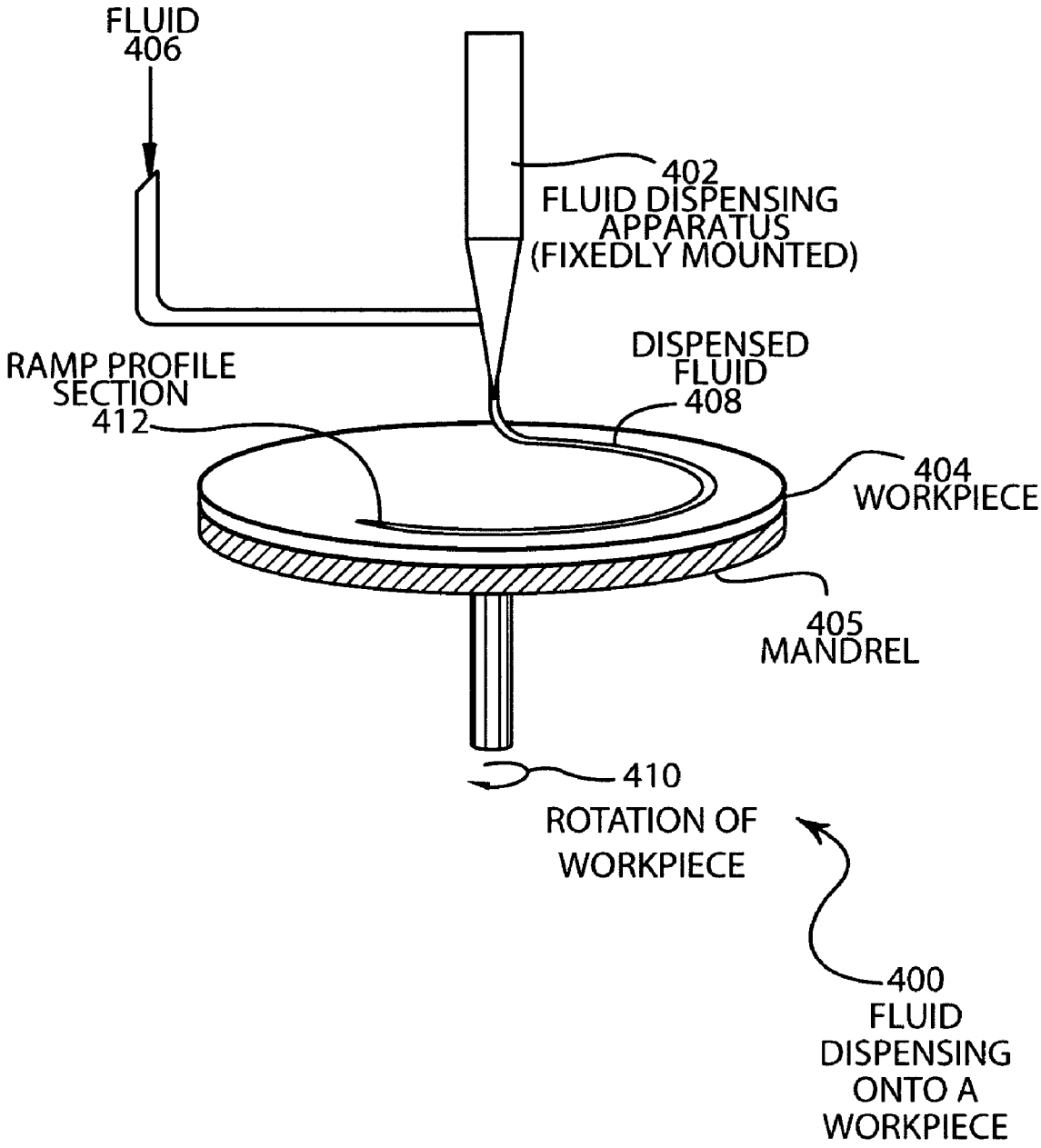
FIG. 4 is a schematic illustration of an embodiment of the present invention showing the application of a fluid to a work piece.

FIG. 4 is an illustration of an embodiment 400 of the present invention showing the application of a fluid 408 to a work piece 404. A fluid dispensing apparatus 402 is mounted over a work piece 404 that is mounted on a mandrel 405 (yoke) which is rotated in the direction 410. Fluid 406 is inserted into to the apparatus 402 that dispenses the fluid 408 in the form of a bead on work piece 404. A ramp profile section 412 may be formed by the fluid dispensing apparatus 402 in a controlled manner in accordance with the desired profile specified to the controller.

The amount of fluid dispensed by the dispensing apparatus is critical in certain applications. As disclosed in U.S. patent application Ser. No. 10/670,176 entitled "Closure Sealant Dispenser," filed Sep. 23, 2003 by Scott J. Woolley et al., which is based upon U.S. Provisional Application 60/412,988 entitled "Can Sealant Dispenser," filed Sep. 23, 2002, both of which are specifically incorporated herein by reference for all that they disclose and teach, yokes that hold can lids for dispensing sealants typically have a constant rotational speed. If the rotating yoke has a constant rotational speed, can tops that are not round in shape have a peripheral area (to which the sealant is to be applied) that have a varying linear speed with respect to the dispenser. For example, an essentially rectangular or square can lid, such as may be used for canned meats, has a peripheral area in which the sealant is to be applied, that varies in rotational speed on a constant speed rotational yoke. The varying rotational speed of non-round can lids is the result of the varying radial distance from the center of the yoke. Hence, even if a dispenser is capable of quickly opening and dispensing a constant amount of fluid, the outer rounded corner portions of the can top that have a higher velocity receive less fluid. For this reason, either the speed of the yoke must be varied, or the opening of the dispenser must be controlled, to allow a constant amount of sealant to be dispensed on such non-round tops. Further, the rounded corner portions of such tops may require more sealant to be dispensed in the corners than on the straight portions of the can top to achieve an effective seal. The ability to control the size of the opening of the dispenser allows the user to control the amount of fluid dispensed by the dispenser. Since the amount of fluid dispensed may vary with the acceleration of the periphery of the can top, profiles can be provided for properly dispensing the fluid in the desired amount at various locations along the periphery of such non-round can tops. In addition, the dispensing head or mandrel may be moved in one direction to ensure proper placement of the material, as disclosed in the above identified application entitled "Closure Sealant Dispenser."

The fluid of the embodiment 400 may comprise a sealant that has a thick paste or gel consistency which is otherwise described herein as a fluid. The work piece may be an item such as a can end that requires a sealant prior to assembly. Those skilled in the arts will appreciate that any type of fluid may be dispensed onto any type of work piece while keeping within the spirit and intent of the present invention.

As shown in FIG. 4, the ramp profile section 412 is created by slowly opening the valve of the fluid dispensing apparatus 402 as the mandrel 405 is rotated. By using the fluid dispensing apparatus 402, that can be controlled to open at any desired rate, a bead of fluid that tapers from nothing to a full bead of sealant may be created. As also shown in FIG. 4, sealant may be continually placed on the work piece 404 until the ramp profile section 412 is underneath the fixedly-mounted fluid dispensing apparatus 402. At such a point, the fluid dispensing apparatus 402 may slowly taper off the fluid in a profile that closely inversely matches the profile used to create the ramp profile section 412, so as to create a uniform bead.

A benefit of the ramp profile section 412 is that registration on a round top is not required and low tolerances are required with respect to the starting and stopping points of the dispenser. Referring to the example illustrated in FIG. 4, the can end may be presented to the dispensing apparatus while the can end is rotated at a high speed. Registration of starting and stopping locations for the sealant with respect to the position of the can end may be very difficult at high speeds. The use of a ramp profile section 412 provides increased throughput of can ends on a sealant machine since a high degree of registration is not necessary, as pointed out above, as a result of the tapered nature of ramp profile section 412.

The embodiment 400 may allow consistent and repeatable amounts of fluid to be dispensed to work pieces. The rate of opening and closing the valve may be varied during the dispensing process, allowing the valve position to be ramped up and down at any desired rate during the dispensing process to change the amount of fluid dispensed.

FIG. 5 is a schematic diagram of a voice coil actuator fluid dispenser 500 that moves the moving portion 510 of the valve with respect to the fixed portion 512 of the valve. The voice coil actuator 502 has a cylindrically shaped stationary permanent magnet that creates a stationary magnetic field within the interior of the voice coil housing. A cylindrical shell, that is capable of moving over the cylindrical permanent magnet is attached to a shaft that moves along the axis of the cylindrical magnet. The cylindrical shell has a series of coils that are wrapped around the circumference of the cylindrical shell. Application of current to the coils generates a magnetic field that interacts with the magnetic field of the cylindrical permanent magnet to cause the shell to move in a linear direction along the axis of the cylindrical magnet, thereby causing linear motion of the shaft. The amount of current applied to the coils is proportional to the force created on the shaft, and hence the movement of the shaft. Controller 516 controls the current in the voice coil actuator 502. The force generated by the voice coil actuator 502 compresses spring 506 against a fixed element 508 of the valve. Spring 506 creates an opposing force to the voice coil 502 that changes in proportion to the amount of the distance moved. By controlling the force from the voice coil actuator 502, the moving portion of the valve 510 follows the motion profile 504. Those skilled in the arts will appreciate that any type of displacement resistant device such as a sealed cylinder, bladder, rubber ball, or other devices or materials that use the principle of modulus of elasticity can be used to create the opposing force created by the spring 506.

The voice coil actuator 502 illustrated in FIG. 5, and the other actuators illustrated in other embodiments disclosed herein, can comprise a variable force actuator such as, but not by way of limitation, an electrical solenoid, a linear motor, a moving coil or a pressurized cylinder. Further, the encoders disclosed herein may be used to provide closed loop control so as to more precisely regulate the movement of the moving portion of the various valves illustrated herein.

FIG. 7 is an illustration of an embodiment of a servo-motor dispenser 700. As shown in FIG. 7 a flow control valve 702 is shown which is coupled to the fluid dispenser 703. A linear direct coupled encoder 704 is coupled to the housing of the flow control valve 702 and directly senses the position of the flow control valve 702. Lead screw 706 is used to control the position of the flow control valve 702 in response to the rotation of the servo-motor 708. Rotational shaft encoder 710 also generates an encoder signal indicating the rotational position of the servo-motor shaft. In effect, the linear direct coupled converter 704 provides feedback information as to the actual position of the valve to calibrate and check the performance of the rotational shaft encoder 710.

Figure 8:
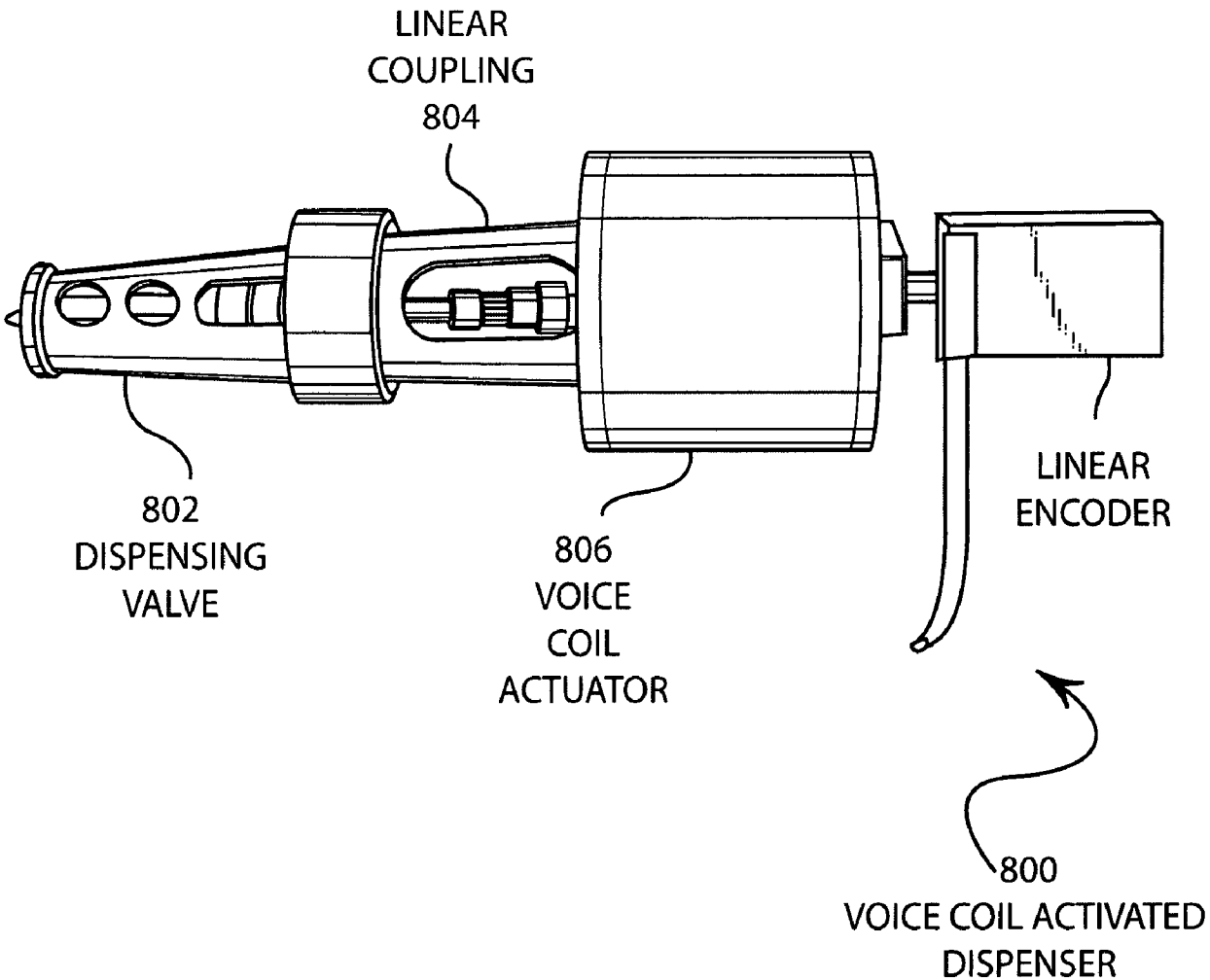
FIG. 8 is an illustration of an embodiment of a voice coil actuated dispenser.

FIG. 8 illustrates another embodiment of a voice coil actuated dispenser 800. As shown in FIG. 8 a dispensing valve 802 is used to dispense the fluid. A linear coupling device 804 is connected to the moving portion of the dispensing value 802. A voice coil actuator 806, in turn, is connected to the linear coupling device 804. Linear encoder 808 generates an electrical signal that is indicative of the position of the moving portion of the dispensing valve 802. The control system, such as illustrated in FIG. 1, can be used with the embodiment illustrated in FIG. 8. The voice coil actuator 806 is capable of very quickly and very precisely moving the shaft of the voice coil actuator that is coupled to the linear coupling 804. Very precise and rapid control of the size of the opening of the dispensing valve 802 can be achieved using the voice coil actuator 806.

The present invention therefore provides a unique system for dispensing fluids in a controlled manner. Flow profiles can be provided to a dispenser to accurately dispense fluid in accordance with a desired profile using a dispenser that has a controlled, variable opening. Positional encoders are used to provide feedback to accurately control the flow of fluid through the dispenser in accordance with the flow profile. Accurate control of the flow profile allows accurate dispensing of fluids in applications such as the dispensing of sealant to can ends which may require different amounts of sealant on different portions of the can end. Further, accurate registration of rapidly rotating can ends is not required as a result of the flow profile that can be provided by the various embodiments of the present invention.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of applying a sealant to a can end in a controlled manner in accordance with a profile comprising:

generating a predetermined profile signal that is representative of said profile, said profile defining a desired position of a moving portion of a dispenser with respect to time;

providing said dispenser that dispenses said sealant to said can end, said dispenser having a fixed portion and said moving portion that define a variable size opening through which said sealant flows through said dispenser;

detecting a position of said moving portion of said dispenser with respect to said fixed portion;

generating an encoder signal that is indicative of said position of said moving portion;

applying said predetermined profile signal and said encoder signal to a controller;

generating a control signal representative of the difference between said predetermined profile signal and said encoder signal;

applying said control signal to an actuator that is coupled to said moving portion that moves said moving portion in response to said control signal so that said moving portion is moved to a position that matches said profile, such that said sealant is dispensed from said dispenser to said can end in accordance with said profile.

2. The method of claim 1 wherein the step of applying said control signal to an actuator comprises:

applying said control signal to a rotary actuator.

3. The method of claim 1 wherein the step of applying said control signal to an actuator comprises:

applying said control signal to a linear actuator.

4. The method of claim 1 wherein the step of applying said control signal to an actuator comprises:

applying said control signal to a servo-motor coupled to a lead screw.

5. The method of claim 1 wherein the step of applying said control signal to an actuator comprises:

applying said control signal to a voice coil actuator.

6. The method of claim 1 wherein said step of generating a profile signal comprises:

generating a profile signal so that a ramp profile section of said sealant is generated.

7. A method of dispensing a sealant onto a can end in a controlled manner in accordance with a profile comprising:

generating a predetermined profile signal that is representative of said profile, said profile defining a desired position of a moving portion of a dispenser with respect to time;

providing said dispenser that dispenses said sealant to said can end, said dispenser having a fixed portion and said moving portion that define a variable size opening through which said sealant flows through said dispenser;

detecting a position of said moving portion of said dispenser with respect to said fixed portion;

generating an encoder signal that is indicative of said position of said moving portion;

applying said predetermined profile signal and said encoder signal to a controller;

generating a control signal representative of the difference between said predetermined profile signal and said encoder signal;

applying said control signal to an actuator that is coupled to said moving portion that moves said moving portion in response to said control signal so that said moving portion is moved to a position that matches said profile, such that said sealant is dispensed from said dispenser in accordance with said profile.

8. The method of claim 7 wherein the step of applying said control signal to an actuator comprises:

applying said control signal to a rotary actuator.

9. The method of claim 7 wherein the step of applying said control signal to an actuator comprises:

applying said control signal to a linear actuator.

10. The method of claim 7 wherein the step of applying said control signal to an actuator comprises:

applying said control signal to a servo-motor coupled to a lead screw.

11. The method of claim 7 wherein the step of applying said control signal to an actuator comprises:

applying said control signal to a voice coil actuator.

12. The method of claim 7 wherein said step of generating a profile signal comprises:

generating a profile signal so that a ramp profile section of said sealant is generated.

* * * * *